US009296508B2

(12) United States Patent
Kanfer et al.

(10) Patent No.: US 9,296,508 B2
(45) Date of Patent: Mar. 29, 2016

(54) COLLAPSIBLE CONTAINERS AND REFILL UNITS

(71) Applicants: Joseph S. Kanfer, Richfield, OH (US); Michael J. Gmerek, III, Massillon, OH (US); Masato Tabata, Akron, OH (US); Robert J. Lang, Alamo, CA (US); Eugene W. Ray, Barberton, OH (US)

(72) Inventors: Joseph S. Kanfer, Richfield, OH (US); Michael J. Gmerek, III, Massillon, OH (US); Masato Tabata, Akron, OH (US); Robert J. Lang, Alamo, CA (US); Eugene W. Ray, Barberton, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/804,077

(22) Filed: Mar. 14, 2013

(65) Prior Publication Data

US 2014/0166650 A1 Jun. 19, 2014

Related U.S. Application Data

(60) Provisional application No. 61/736,594, filed on Dec. 13, 2012.

(51) Int. Cl.

| | |
|---|---|
| ***B65D 1/02*** | (2006.01) |
| ***B05B 1/00*** | (2006.01) |
| ***B05B 11/00*** | (2006.01) |
| *A47K 5/12* | (2006.01) |

(52) U.S. Cl.

CPC ..... *B65D 1/0292* (2013.01); *B05B 11/0045* (2013.01); *A47K 5/12* (2013.01); *B05B 11/0059* (2013.01); *B05B 11/30* (2013.01); *B65D 2501/0018* (2013.01); *B65D 2501/0036* (2013.01); *B65D 2501/0081* (2013.01)

(58) Field of Classification Search

CPC ..... B65D 1/0292; B65D 2501/0018; B65D 2501/0036; B65D 2501/0081; B05B 11/0045; B05B 11/0059; B05B 11/30; A47K 5/12

USPC ..... 215/382, 900; 220/666, 667, 669

See application file for complete search history.

(56) References Cited

U.S. PATENT DOCUMENTS

| | | | | | |
|---|---|---|---|---|---|
| 3,319,684 | A | * | 5/1967 | Calhoun | 604/326 |
| 3,926,341 | A | * | 12/1975 | Lhoest | 222/95 |
| 4,492,313 | A | | 1/1985 | Touzani | |

(Continued)

FOREIGN PATENT DOCUMENTS

| | | | |
|---|---|---|---|
| EP | 0287170 | A2 | 10/1988 |
| EP | 0164173 | B1 | 5/1991 |

(Continued)

OTHER PUBLICATIONS

PCT International Search Report and Written Opinion, Dated Mar. 6, 2014, Application No. PCT/US2013/074295.

*Primary Examiner* — Robert J Hicks
*Assistant Examiner* — Niki Eloshway
(74) *Attorney, Agent, or Firm* — Calfee, Halter & Griswold LLP

(57) ABSTRACT

Exemplary embodiments of collapsible containers are disclosed herein. Some exemplary embodiments include a container having a plurality of sides. The plurality of sides forms a substantially geometric shape, such as a rectangular shape. A plurality of predetermined fold lines extend substantially across each of the sides and the predetermined fold lines form a plurality of geometric shapes. A plurality of predetermined fold lines for inner folds on a first side are aligned with a plurality of predetermined fold lines for outer folds on a second side.

15 Claims, 7 Drawing Sheets

(56) References Cited

U.S. PATENT DOCUMENTS

| | | | | |
|---|---|---|---|---|
| RE32,379 | E | 3/1987 | Touzani | |
| D292,555 | S | 11/1987 | Chesterfield | |
| 4,873,100 | A | 10/1989 | Dirksing | |
| 5,083,678 | A | 1/1992 | Waring | |
| D323,984 | S | 2/1992 | Hamilton | |
| 5,174,458 | A | 12/1992 | Segati | |
| 5,201,438 | A * | 4/1993 | Norwood | 220/666 |
| 5,255,808 | A * | 10/1993 | Tobler | 220/6 |
| 5,310,068 | A | 5/1994 | Saghri | |
| 5,333,761 | A | 8/1994 | Davis et al. | |
| 5,348,173 | A | 9/1994 | Norwood | |
| 5,445,288 | A | 8/1995 | Banks | |
| D370,178 | S | 5/1996 | Petre | |
| D370,388 | S | 6/1996 | Cusick | |
| 5,524,789 | A * | 6/1996 | Jackman | 220/666 |
| 5,556,005 | A | 9/1996 | Banks | |
| D401,344 | S | 11/1998 | Bonds | |
| D403,587 | S | 1/1999 | Thornley | |
| 6,223,932 | B1 * | 5/2001 | Usui | 220/666 |
| D455,069 | S | 4/2002 | Johnson | |
| 6,598,755 | B1 | 7/2003 | Pedulla et al. | |
| 6,641,002 | B2 | 11/2003 | Gerenraich et al. | |
| 7,207,451 | B2 | 4/2007 | Taylor et al. | |
| 7,530,475 | B2 | 5/2009 | Ophardt | |
| 7,607,564 | B2 | 10/2009 | Churvis et al. | |
| 7,651,781 | B2 | 1/2010 | Richards et al. | |
| 7,735,300 | B2 | 6/2010 | Outreman | |
| 7,802,691 | B2 | 9/2010 | Musalek | |
| 7,819,263 | B1 | 10/2010 | Dicarlo-Nelson | |
| 7,828,772 | B2 | 11/2010 | Kriesel et al. | |
| 7,857,156 | B2 | 12/2010 | Inomata | |
| 7,857,172 | B2 * | 12/2010 | Harvey | B05B 11/3047 215/319 |
| 7,866,500 | B1 | 1/2011 | Peggs | |
| 8,158,052 | B2 | 4/2012 | Richards et al. | |
| 8,178,140 | B2 | 5/2012 | Kuboi et al. | |
| 8,182,683 | B1 | 5/2012 | Allen | |
| 8,215,509 | B2 * | 7/2012 | Kuboi et al. | 215/381 |
| 8,328,043 | B2 * | 12/2012 | Kessell et al. | 220/666 |
| 8,596,448 | B2 * | 12/2013 | Sempe | 206/6 |
| 2003/0075562 | A1 | 4/2003 | Gerenraich | |
| 2003/0160055 | A1 | 8/2003 | Stewart-Stand | |
| 2004/0040971 | A1 * | 3/2004 | Athalye | 220/666 |
| 2007/0000859 | A1 | 1/2007 | Pedulla | |
| 2007/0034098 | A1 | 2/2007 | Labeille et al. | |
| 2007/0045319 | A1 | 3/2007 | Hogan | |
| 2007/0145000 | A1 | 6/2007 | Musalek | |
| 2007/0219502 | A1 | 9/2007 | Kriesel et al. | |
| 2008/0023359 | A1 | 1/2008 | Churvis et al. | |
| 2008/0093368 | A1 * | 4/2008 | Muzik et al. | 220/666 |
| 2008/0113060 | A1 | 5/2008 | Richards et al. | |
| 2008/0197037 | A1 | 8/2008 | O'Brien et al. | |
| 2008/0247682 | A1 | 10/2008 | Murray | |
| 2008/0284063 | A1 | 11/2008 | Richards et al. | |
| 2009/0114617 | A1 | 5/2009 | Inomata | |
| 2009/0114679 | A1 | 5/2009 | Ophardt et al. | |
| 2009/0173739 | A1 | 7/2009 | Hogan | |
| 2009/0242503 | A1 | 10/2009 | Kuboi et al. | |
| 2009/0242504 | A1 | 10/2009 | Kuboi et al. | |
| 2010/0018166 | A1 | 1/2010 | Outreman | |
| 2010/0044916 | A1 | 2/2010 | Richards et al. | |
| 2010/0072166 | A1 | 3/2010 | Dickie | |
| 2010/0072167 | A1 | 3/2010 | Dickie | |
| 2010/0140294 | A1 | 6/2010 | Bourguignon et al. | |
| 2010/0270199 | A1 | 10/2010 | Nazari | |
| 2011/0036806 | A1 | 2/2011 | Gregg et al. | |
| 2011/0121006 | A1 | 5/2011 | Nottingham et al. | |
| 2011/0121007 | A1 | 5/2011 | Nottingham et al. | |
| 2011/0121026 | A1 | 5/2011 | Nottingham et al. | |
| 2012/0070104 | A1 | 3/2012 | Antonio | |
| 2012/0097634 | A1 | 4/2012 | Riedl | |
| 2012/0145710 | A1 | 6/2012 | Corbett et al. | |
| 2012/0211520 | A1 | 8/2012 | Ciavarella et al. | |

FOREIGN PATENT DOCUMENTS

| | | | |
|---|---|---|---|
| EP | 0802760 | B1 | 6/2000 |
| EP | 1150889 | B1 | 6/2003 |
| EP | 1508522 | A1 | 2/2005 |
| EP | 1591369 | A1 | 11/2005 |
| EP | 1706326 | B1 | 8/2007 |
| EP | 1626007 | B1 | 9/2008 |
| EP | 2047966 | A2 | 4/2009 |
| EP | 2054308 | A1 | 5/2009 |
| EP | 1955954 | B1 | 3/2010 |
| EP | 2104631 | B1 | 7/2012 |
| WO | 9429180 | A1 | 12/1994 |
| WO | 9621387 | A1 | 7/1996 |
| WO | 0043276 | A1 | 7/2000 |
| WO | 0044630 | A1 | 8/2000 |
| WO | 2005061336 | A1 | 7/2005 |
| WO | 2007094479 | A1 | 8/2007 |
| WO | 2008017823 | A1 | 2/2008 |
| WO | 2008022605 | A1 | 2/2008 |
| WO | 2008075975 | A2 | 6/2008 |
| WO | 2008095849 | A1 | 8/2008 |
| WO | 2008124472 | A1 | 10/2008 |
| WO | 2009078858 | A1 | 6/2009 |
| WO | 2009081167 | A1 | 7/2009 |
| WO | 2010042897 | A1 | 4/2010 |
| WO | 2010148433 | A2 | 12/2010 |
| WO | 2010148461 | A2 | 12/2010 |
| WO | 2012051093 | A2 | 4/2012 |
| WO | 2012069080 | A1 | 5/2012 |
| WO | 2012078929 | A2 | 6/2012 |

* cited by examiner

COLLAPSIBLE CONTAINERS AND REFILL UNITS

RELATED APPLICATIONS

This non-provisional utility patent application claims priority to and the benefits of U.S. Provisional Patent Application Ser. No. 61/736,594 filed on Dec. 13, 2012 and entitled COLLAPSIBLE CONTAINER. This application is incorporated herein by reference in its entirety.

TECHNICAL FIELD

The present invention relates generally to collapsible containers for fluid and more particularly to collapsible containers having a controlled collapse.

BACKGROUND OF THE INVENTION

Liquid dispenser systems, such as liquid soap and sanitizer dispensers, utilize collapsible containers filled with the liquid soap or sanitizer. The collapsible containers collapse due to vacuum pressure created in the container as the fluid is pumped out of the collapsible container. Often the collapsible containers twist when collapsing and interfere with operation of the dispensers. In addition, as the fluid draws down in the collapsible containers, the vacuum pressure needed to remove the fluid tends to increase. As a result of the increased vacuum pressure required to pump the fluid out of the container, the volume of the fluid output by the pump is inconsistent. In addition, the increased vacuum pressure requires additional force to operate the dispensers, which is of particular concern in electronically activated dispensers.

SUMMARY

Exemplary embodiments of collapsible containers are disclosed herein. Some exemplary embodiments include a container having a plurality of sides. The plurality of sides forms a substantially geometric shape, such as a rectangular shape. A plurality of predetermined fold lines extend substantially across each of the sides and the predetermined fold lines form a plurality of geometric shapes. A plurality of predetermined fold lines for inner folds on a first side are aligned with a plurality of predetermined fold lines for outer folds on a second side.

Some exemplary embodiments include a container having a plurality of sides. The plurality of sides forms a substantially rectangular shape. A plurality of predetermined fold lines extend substantially across each of the sides. The predetermined fold lines form a plurality of substantially trapezoidal shapes, wherein an inside fold line on a first side connects with an outside fold line on a second side.

Some exemplary embodiments of collapsible containers include a container having a having a plurality of predetermine fold lines. At least one predetermined fold line on a first side folds inward, and at least one predetermined fold line on a second side folds outward. The at least one predetermined fold line that folds inward is connected to the at least one predetermined fold line that folds outward, and the predetermined fold lines form a plurality of geometric shapes.

BRIEF DESCRIPTION OF THE DRAWINGS

These and other features and advantages of the present invention will become better understood with regard to the following description and accompanying drawings in which.

DETAILED DESCRIPTION

The exemplary embodiments of collapsible containers shown and described herein may be used for many applications, such as for example, in a refill unit for a soap or sanitizer dispenser. Although these containers may be used in virtually any dispenser, exemplary embodiments of suitable soap and sanitizing dispensers may be found in U.S. Pat. No. 7,086,567, titled Wall-Mounted Dispenser Assembly With Transparent Window, filed on Jul. 25, 2002; and U.S. Patent Publication No. 2010/0059550, titled Pump Having a Flexible Mechanism for Engagement With a Dispenser, filed on Sep. 11, 2009, which are incorporated herein in their entirety by reference. Although these containers may be used with many different types of pumps, exemplary embodiments of suitable pumps for use with these collapsible containers may be found in U.S. patent application Ser. No. 13/208,076, titled Split Body Pumps for Foam Dispensers and Refill Units, filed on Aug. 11, 2011; U.S. Provisional Patent Application No. 61/692,290, titled Horizontal Pumps, Refill Units and Foam Dispensers With Integral Air Compressors, filed on Aug. 23, 2012; and U.S. Provisional Patent Application No. 61/695,140, titled Horizontal Pumps, Refill Units and Foam Dispensers, filed on Aug. 30, 2012, each of which is incorporated in its entirety herein by reference. In some exemplary embodiments, the collapsible containers described herein are connected to a pump, such as those incorporated above, and used to refill soap or sanitizing dispensers, such as those incorporated above. Because exemplary embodiments of dispensers and pumps are fully described in the incorporated patents, they are not described in detail herein.

Figure 1:
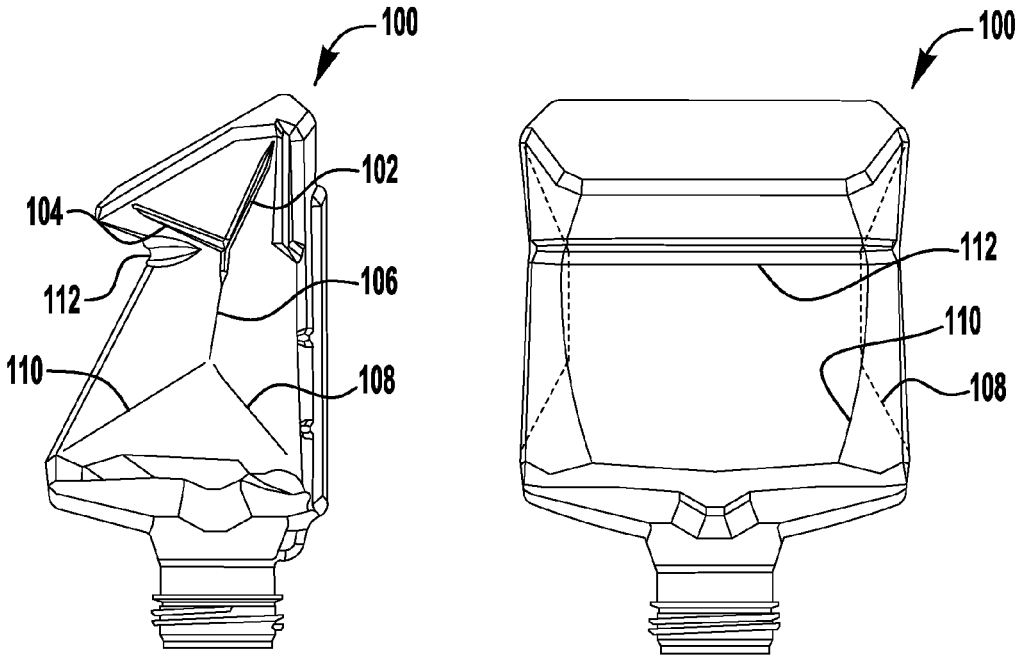
FIG. 1 ( Prior Art )
FIGS. 1, 2A and 2B illustrate prior art collapsible containers.

FIG. 1 illustrates a prior art collapsible container 100. Collapsible container 100 includes a plurality of predetermined fold lines 102, 104, 106, 108, 110 and 112. These predetermined fold lines 102-112 attempt to cause the collapsible container 100 to collapse or fold along these lines. Unfortunately, many collapsible containers, such as collapsible container 100, tend to twist as they collapse. Twisting of the container causes problems such as, for example, adding a side load to the pump, which increases the power required to operate the pump and may cause leakage. Twisting of the containers also makes the container difficult to remove from the dispenser. In addition, as the collapsible containers collapse, the vacuum pressure in the collapsible container increases causing inconsistency in the pump output and also increases power necessary to operate the pump. In addition, twisting refills can impart force against the dispenser itself. This may cause the cover to bulge out and/or put stress on the latches.

Figure 2A:
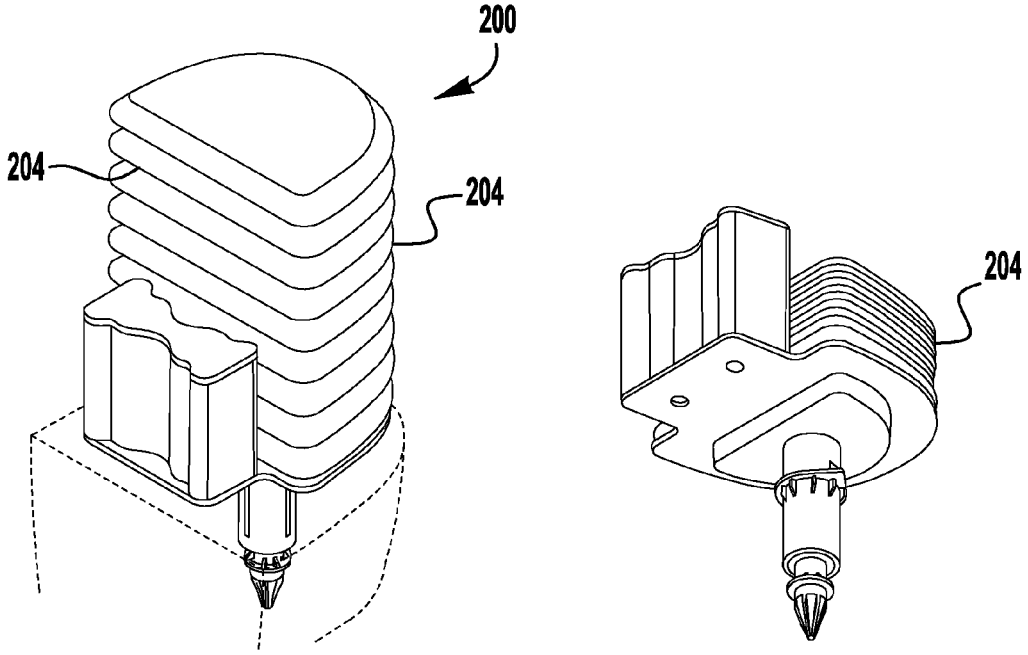
FIG. 2A ( Prior Art )
Figure 2B:
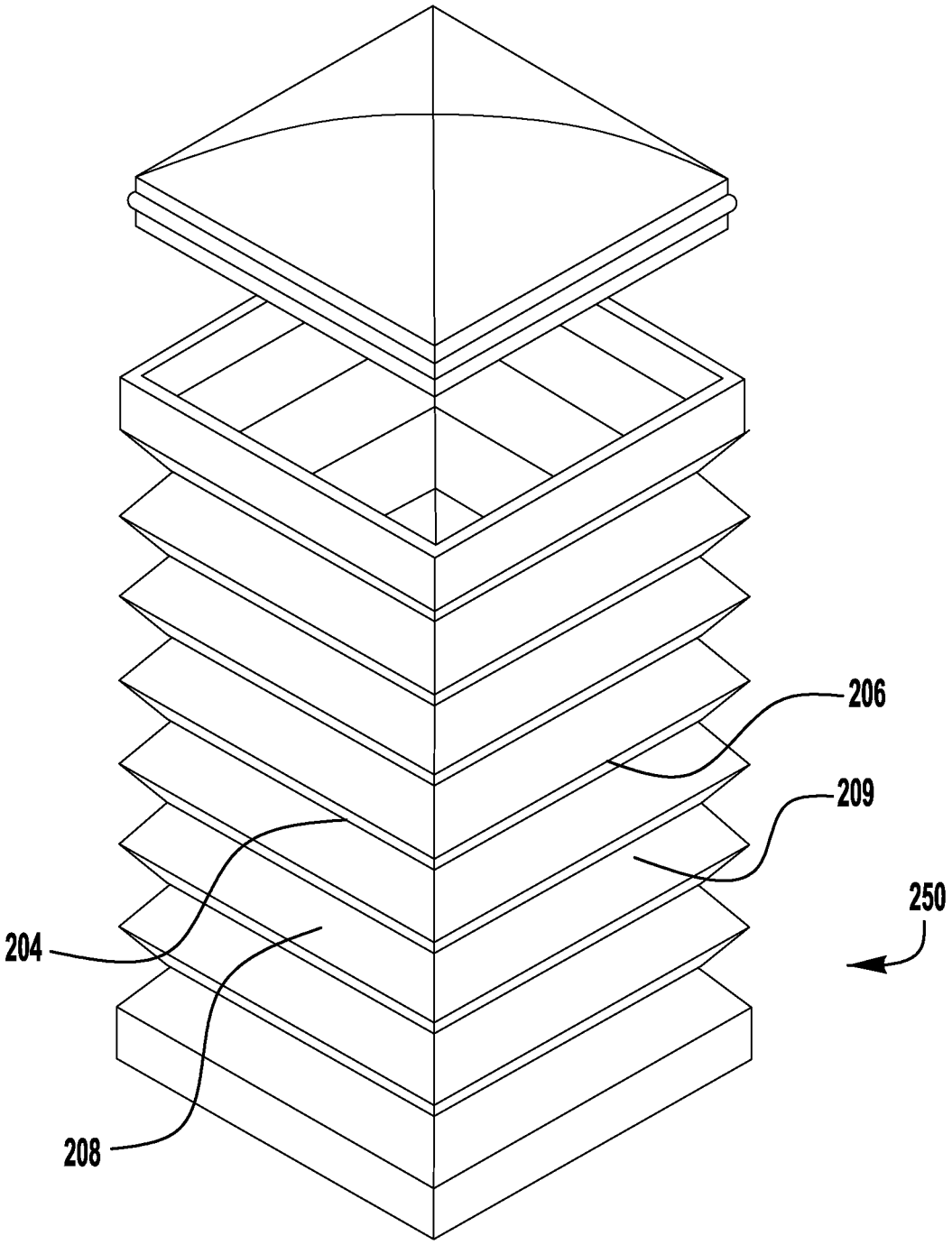
FIG. 2B ( Prior Art )

Prior art bellows-style collapsible containers are disclosed in FIGS. 2A and 2B. FIG. 2A illustrate a bellows-style collapsible container for a soap dispenser. The first portion of FIG. 2A illustrates the bellows in an expanded position, and the second portion illustrates the bellows in a collapsed position. The collapsible container 200 is a bellows-style collapsible container and has predetermined fold lines 204. As used herein, the term "predetermined fold line" is a line where the collapsible container is designed to fold. The prior art bellows-type containers disclose predetermined fold lines wherein the inside fold lines continue around the entire container, that is a fold line that folds inward on one side also folds inward on the adjacent sides. Similarly, fold lines that fold outward on one side fold outward on the adjacent sides.

In some embodiments, the predetermined fold line occurs where the material that the collapsible container is made out of changes directions of bends. Collapsible container 200 tends to collapse in a controlled fashion; however, these bellows-style collapsible containers require a significant amount of force to collapse. It is believed that bellows-type containers require a significant amount of force to compress because as the container collapses, the material at the fold lines is forced to stretch.

Figure 3A:
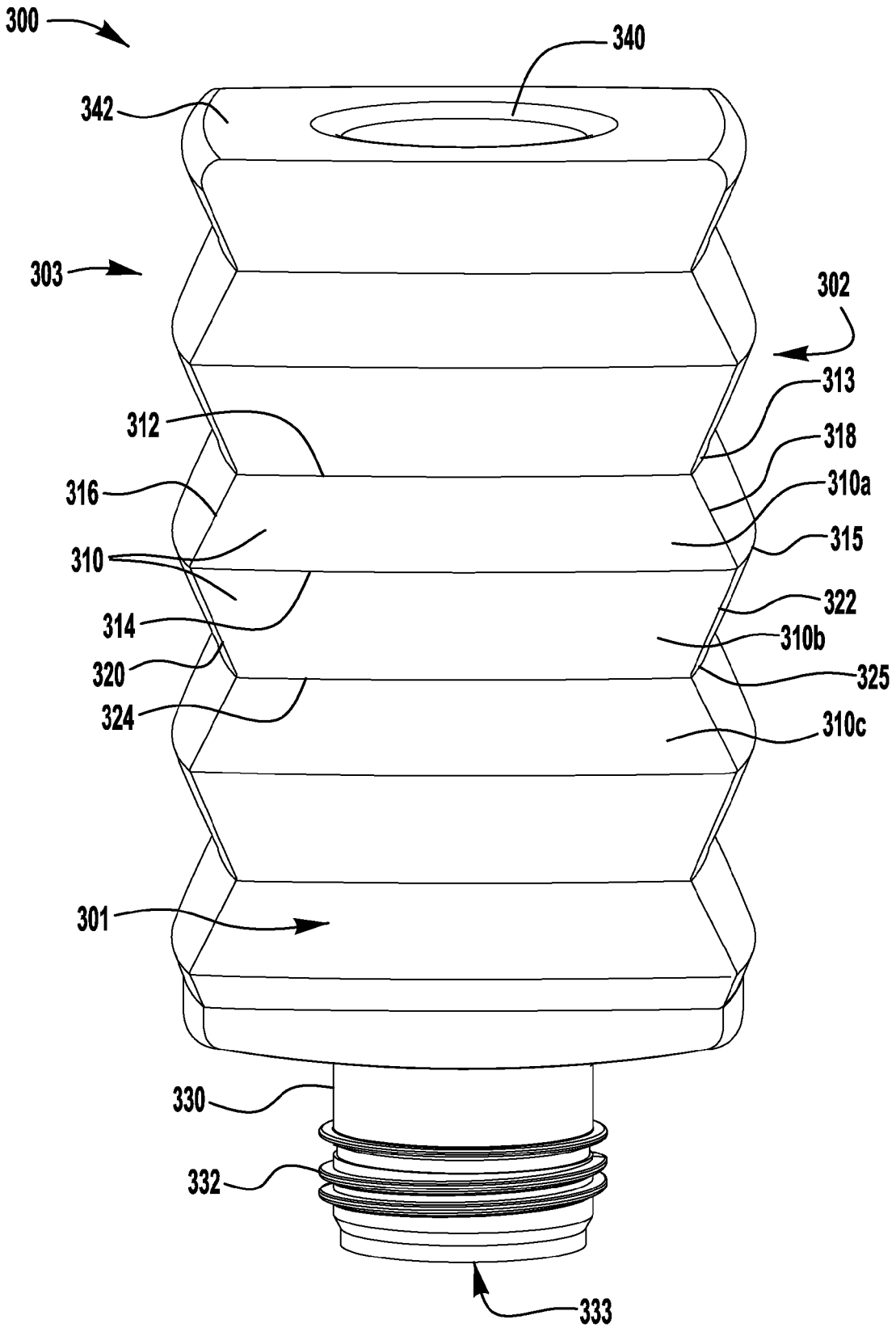
FIG. 3A illustrates a side view of an exemplary embodiment of a collapsible container.
Figure 3B:
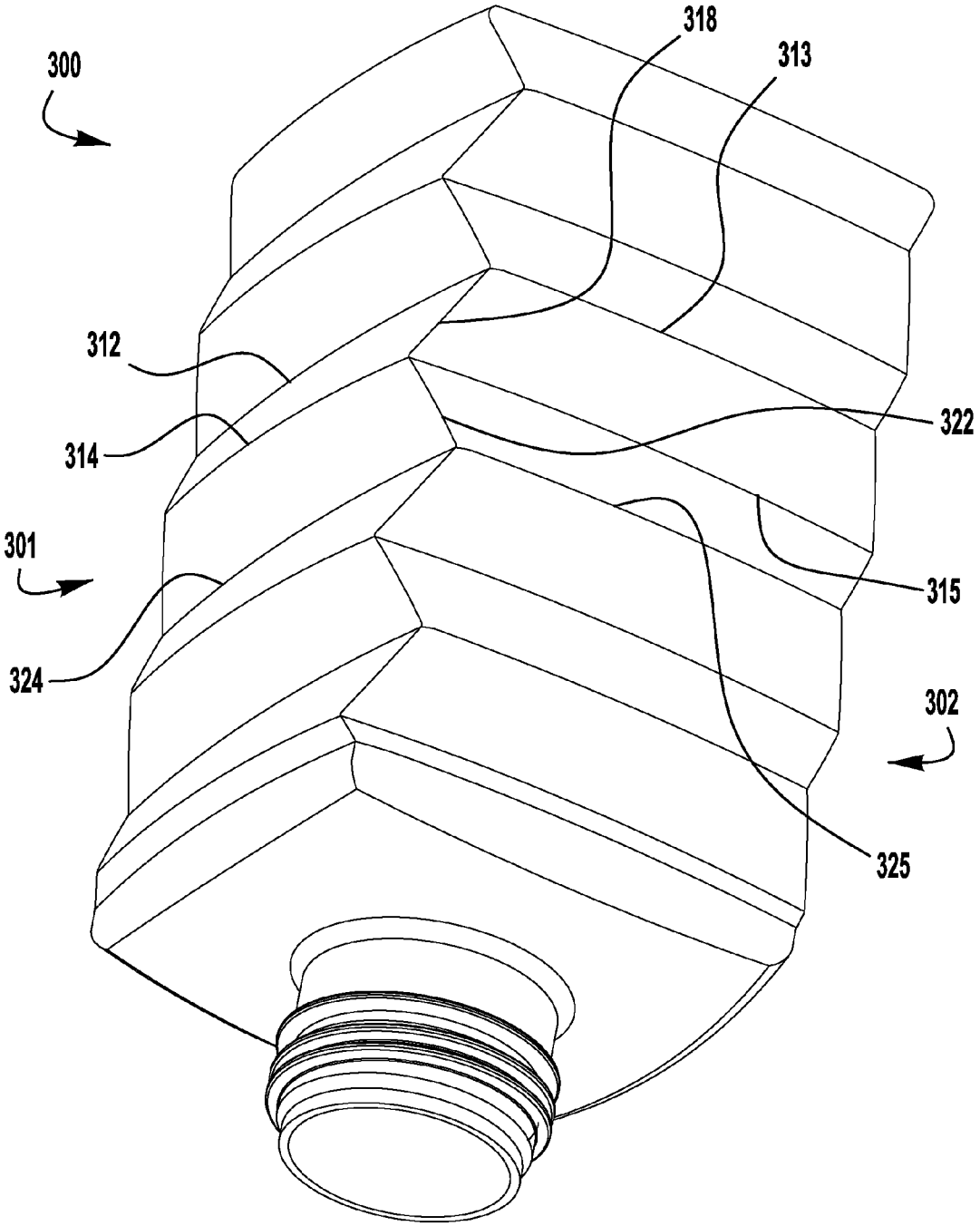
FIG. 3B is a prospective view of the exemplary embodiment of FIG. 3A.

FIG. 2B illustrates another bellows-style container 250. Bellows-style container 250 includes a plurality of fold lines 204, 206, 208 and 209. Fold line 204 is on a first side and fold line 206 is on a second side. The fold lines 204 and 206 are both outside fold lines and connect to one another. Similarly, inside fold lines 208 and 209 connect to one another. This type of collapsible container 250 tends to collapse in a controlled fashion; however it also requires a significant amount of force to collapse. As noted above, it is believed that these types of bellows containers require a lot of force to compress because as the container collapses, the material at the fold lines is forced to stretch FIGS. 3A and 3B illustrate an exemplary embodiment of a collapsible container 300 of the present invention. Collapsible container 300 is four sided and has a rectangular shape, but could have more or fewer sides. Exemplary embodiments of collapsible container 300 may have a square shape, a triangular shape, an octagonal shape or the like. As used herein, the term rectangular means that the overall appearance is rectangular even though the sides may be slightly curved or bowed inward or outward. Similarly, the other shapes may have curved or bowed sides. Thus, the use of the term rectangular (or other geometric shapes) is broader than the geometric shape straight sides. Accordingly, for example, the term rectangular shaped has the same meaning as substantially rectangular shaped.

Collapsible container 300 has a plurality of sides 301, 302, 303. Each side is made up of a plurality of trapezoidal shapes 310. The trapezoidal shapes 310 are formed by, for example, predetermined fold lines 312, 314, 316 and 318. Predetermined fold lines 312, 314, 324 are substantially parallel. Trapezoidal shapes 310*a* and 310*b* share a common predetermined fold line 314, which is a long predetermined fold line. Trapezoidal shapes 310*b* and 310*c* share a common predetermined fold line 324, which is a shorter predetermined fold line.

In one embodiment, collapsible container 300 includes a neck 330 for connecting a pump (not shown) to the container 300. In some embodiments, neck 330 contains threads 332. Collapsible container 300 includes a top 342. In some embodiments top 342 includes a cavity 340. In some embodiments, cavity 340 is sized slightly larger than neck 330 and threads 332 of opening 333. Thus, collapsible container 300 may be stacked on top of other collapsible containers with the neck of one collapsible container located at least partially within in the cavity of a second collapsible container. In some embodiments, the collapsible containers are stacked in a collapsed manner, and in some embodiments they are stacked in a collapsed manner with the neck of one collapsible container located at least partially within the cavity of the second collapsible container.

Many of the fold lines may be characterized as outside fold lines, such as fold lines 312, 315 and 324. Other fold lines, such as, fold lines 313, 314 and 325 may be characterized as inside fold lines. Outside fold lines of one side connect to inside fold lines on adjacent sides. For example, outside fold lines 312 and 324 on side 301 connect to inside fold lines 313 and 325 respectively on side 302. Corner fold lines 318 and 322 are arranged at compound angles and multiple corner fold lines form a "zigzag" pattern, which is more clearly illustrated in FIG. 3B.

Figure 4A:
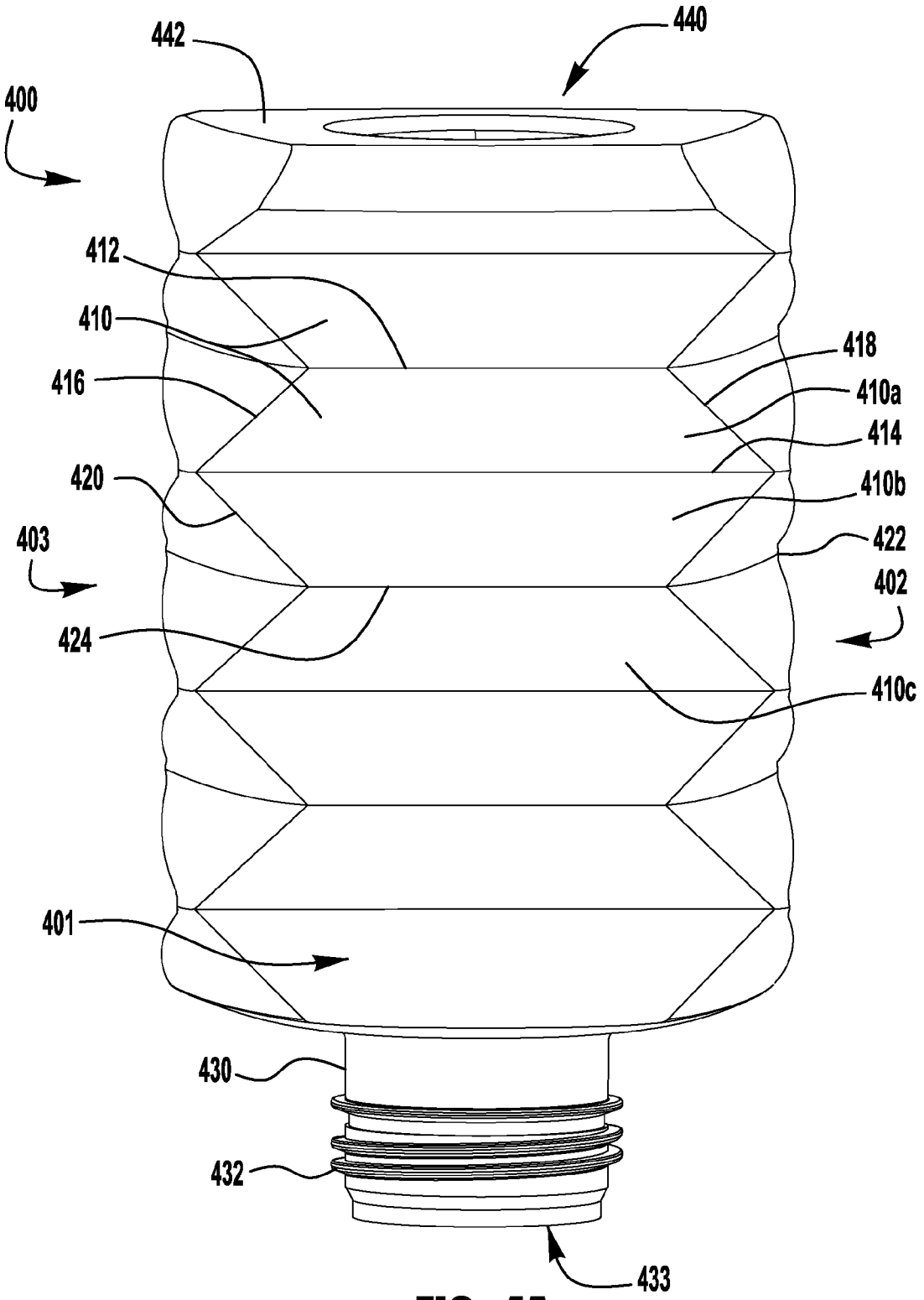
FIGS. 4A and 4B illustrate side views of another exemplary embodiment of a collapsible container.
Figure 4B:
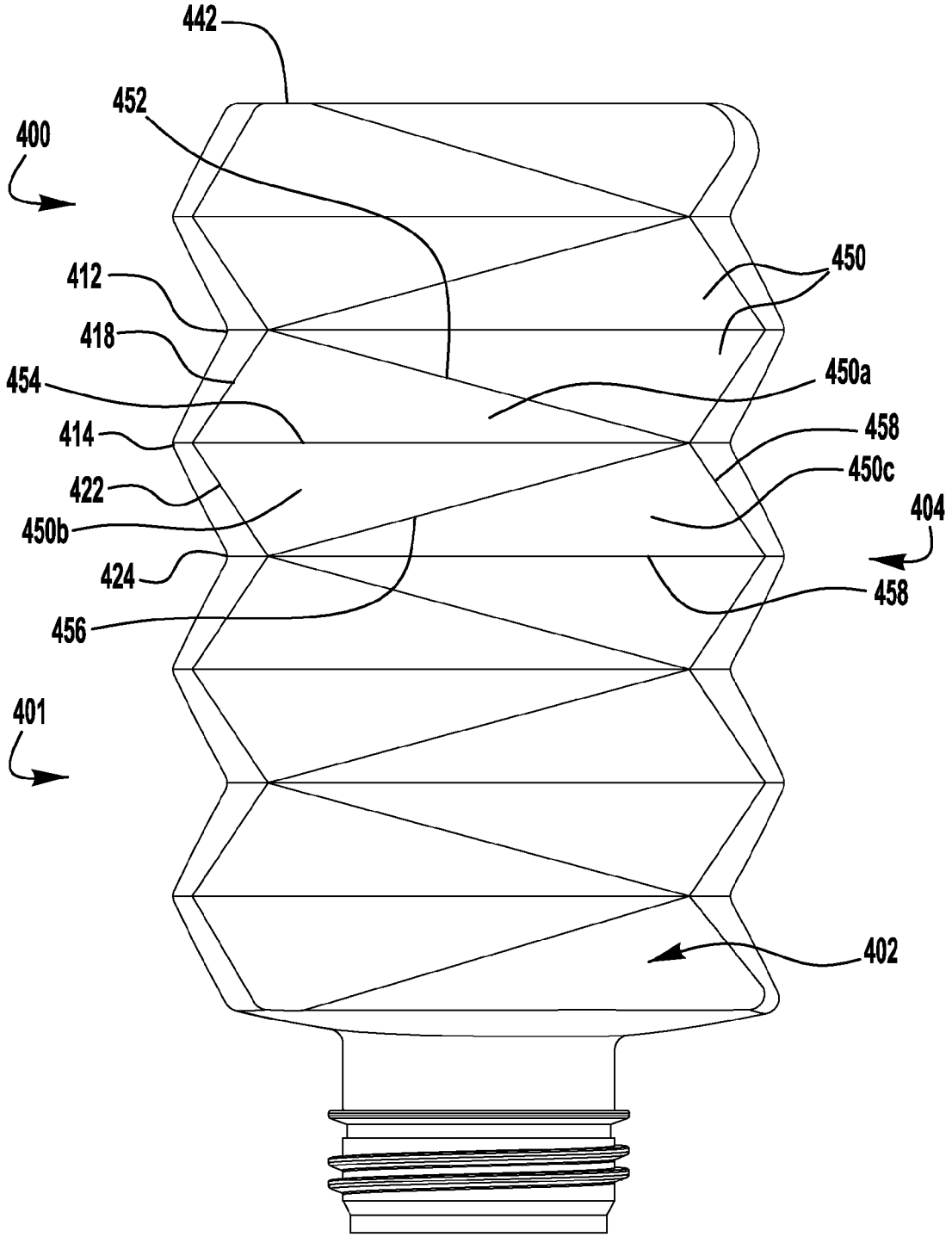
Figure 4C:
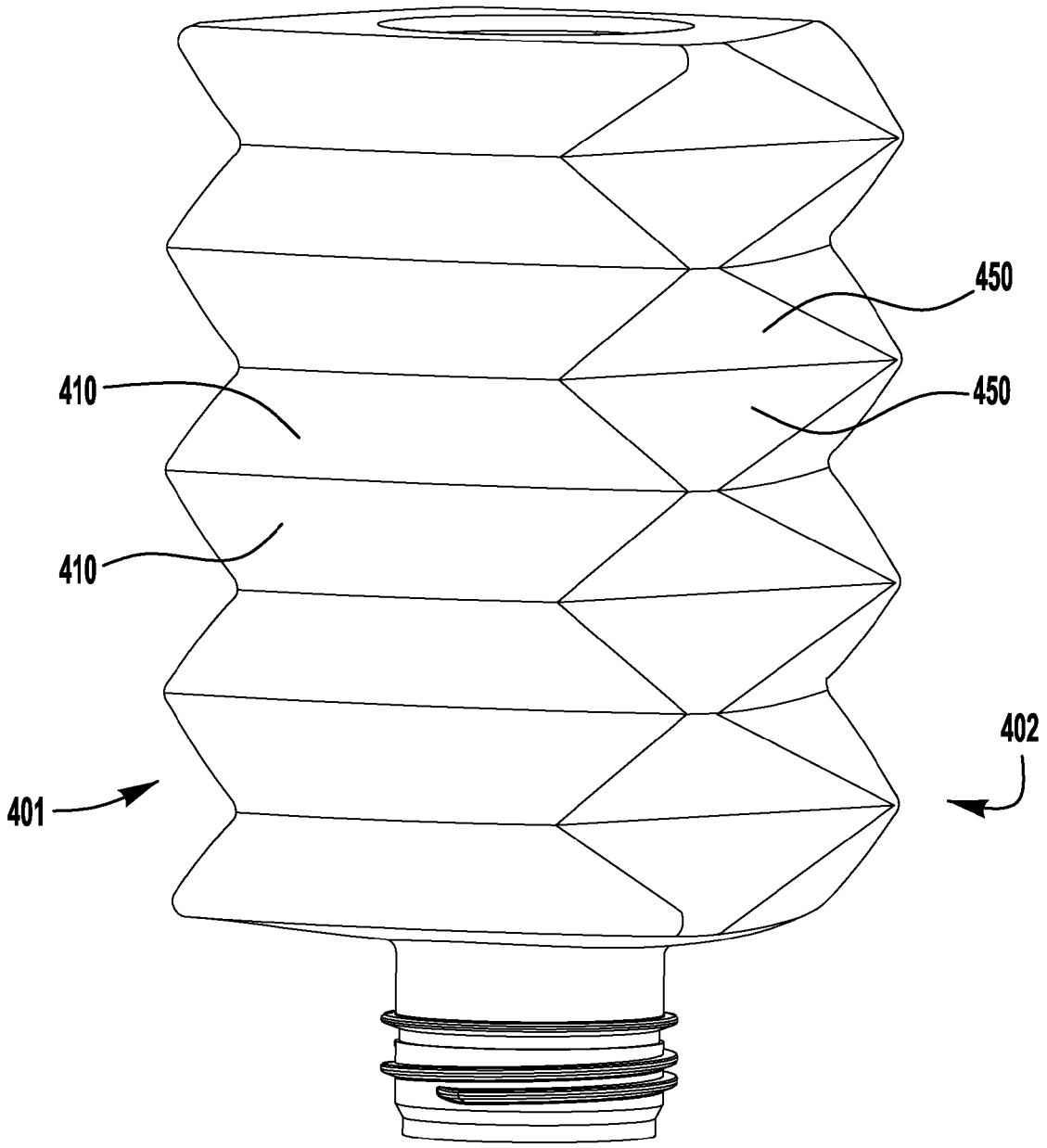
FIG. 4C is a prospective view of the exemplary embodiment of FIGS. 4A and 4B.

FIGS. 4A, 4B and 4C illustrate another exemplary collapsible container 400. Collapsible container 400 has a substantially rectangular shape, but as described above with respect to collapsible bottle 300, collapsible bottle 400 may have more or fewer sides and may have other geometric shapes such as, for example, a square shape, an octagonal shape, a triangular shape or the like. FIG. 4A illustrates first side 401, which includes a plurality of predetermined fold lines 412, 414, 416, 418, 420, 422 and 423. These predetermined fold lines form trapezoidal shaped elements, such as for example shapes 410*a*, 410*b* and 410*c*. On first side 401, predetermined fold lines 412, 414, 424 are substantially parallel, and are substantially parallel to the bottom 442 of the container.

FIG. 4B illustrates a second side of exemplary collapsible container 400. Side 402 includes a plurality of predetermined fold lines 418, 422, 452, 454, 456 and 458. These predetermined fold lines form a plurality of triangular shapes 450*a*, 450*b* and 450*c*. Predetermined fold lines 454 and 458 are substantially parallel across side 401 and are substantially parallel to the bottom 442 of the container. Predetermined fold lines 452, 456 are diagonal fold lines that extend substantially across the entire side 402. FIG. 4C is a prospective view of the container illustrated in FIGS. 4A and 4B.

In some embodiments, the collapsible containers are connected to a pump. In some embodiments, the pump is a liquid pump and in some embodiments the pump is a foam pump, or a liquid pump and an air pump. In some embodiments, the container is filled with a liquid, such as, for example, a soap or sanitizer. In some embodiments, the liquid is a foamable soap or sanitizer.

In some embodiments, the container is partially filled with a concentrated liquid for shipping. If the container is partially filled with a concentrate liquid, the container may include a sealable opening for filling the container with a diluent when the container reaches its destination. In some embodiments, the sealable opening is sealed by a pump upon filling the container with the diluent.

In some embodiments, the containers are stackable on one another. In some embodiments, at least a portion of the neck of a first container fits at least partially within a recess in a second container.

The exemplary collapsible containers may be used with liquids such as soap, sanitizers, detergents, beverages or the like.

Other geometrical shapes may be used on collapsible bottles. In some embodiments, various geometric shapes are used such that an inside fold line on a first side intersects with an outside fold line on an adjacent side.

Embodiments of the novel collapsible containers were filled with foamable liquid soap and had standard foam pumps secured to their necks and placed in standard foam dispensers to compare the vacuum pressures generated to collapse the novel collapsible containers with prior art collapsible containers, similar to the one shown and described in FIG. 1. The test results demonstrated that the novel collapsible bottles have a more stable vacuum pressure to collapse the containers. The vacuum pressure is caused by pumping the foamable liquid out of the container.

In addition, when a container collapses to a point when the bottle is nearly empty, the vacuum pressure spikes because the bottle is deformed to a point where its surfaces are trying to fold over on each other. The vacuum pressure in the novel collapsible container does not spike as early as the vacuum pressure in the prior collapsible container.

Furthermore, the vacuum pressure for the novel collapsible containers at the inflection point, the point where the pump starts to lose output and at the end (where the pump has three 0.0 ml actuations) was significantly lower in the novel collapsible containers than in the prior containers. Testing of one of the novel embodiments of the collapsible containers revealed vacuum pressures of 2 inches of mercury (inHg) at the inflection point and of about inHg at their ends. The prior art collapsible container had a vacuum pressures for their inflection points of between about 3.8 and 6 inHg and had vacuum pressures at their end ranging from 4 to 7.5 inHg.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A collapsible container comprising:

a container having a plurality of sides;

the plurality of sides forming a substantially rectangular shape;

three or more predetermined fold lines extending substantially across each of the sides;

the predetermined fold lines forming a plurality of geometric shapes; and wherein the fold lines on at least one side comprise a plurality of triangular shapes and the fold lines on at least one other side comprise at least three sets of trapezoidal shapes; and wherein each set of the at least three sets of trapezoidal shapes includes a pair of trapezoidal shapes with a common fold line and wherein that common fold line is along a longest leg on each of the pair of trapezoidal shapes.

2. The collapsible container of claim 1 wherein two or more trapezoidal shapes share a common predetermined fold line.

3. The collapsible container of claim 1 having a vacuum pressure when collapsing the container by pumping liquid out of the container of below about 3 in Hg at an inflection point.

4. The collapsible container of claim 1 having a vacuum pressure when collapsing the container by pumping liquid out of the container of below about 3 in Hg at an end point.

5. A collapsible container comprising:

a container having a plurality of sides;

the plurality of sides forming a substantially rectangular shape;

three or more predetermined fold lines extending substantially across each of the sides;

the predetermined fold lines forming a plurality of geometric shapes; and wherein the fold lines on at least one side comprise a plurality of triangular shapes and the fold lines on at least one other side comprise a plurality of trapezoidal shapes; and wherein the plurality of trapezoidal shapes are connected to one another such that a first leg is shared by a first and second trapezoid and a second leg is shared by the second trapezoid and a third trapezoid wherein the first leg and the second leg are different lengths.

6. The collapsible container of claim 5 wherein the first leg and the second leg are parallel to each other.

7. A collapsible container comprising:

a container having a plurality of sides;

the plurality of sides forming a substantially rectangular shape;

three or more predetermined fold lines extending substantially across each of the sides;

the predetermined fold lines forming a plurality of geometric shapes; and wherein a plurality of predetermined fold lines for inner folds on a first side are aligned with a plurality of predetermined fold lines for outer folds on a second side wherein the geometric shapes comprise triangular shapes, wherein two or more triangular shapes share a common predetermined fold line; and wherein a plurality of predetermined fold lines form at least three sets of trapezoidal shapes;

wherein each set of the at least three sets of trapezoidal shapes includes a pair of trapezoidal shapes with a common fold line and wherein that common fold line is along a longest leg on each of the pair of trapezoidal shapes.

8. A collapsible container comprising:

a container having a plurality of sides and a plurality of corners;

the plurality of sides forming a substantially rectangular shape;

three or more predetermined fold lines extending substantially across each of the sides;

the predetermined fold lines forming a plurality of geometric shapes; and wherein the fold lines on at least one side comprise a plurality of triangular shapes and the fold lines on at least one other side comprise a plurality of trapezoidal shapes; and wherein the fold lines on a plurality of the corners of the container form a zigzag pattern.

9. A collapsible container comprising:

a plurality of sides and a plurality of corners;

the plurality of sides forming a substantially geometric shape;

a plurality of predetermined fold lines extending substantially across a first side;

the plurality of predetermined fold lines forming a portion of at least three sets of substantially trapezoidal shapes;

wherein each set of the at least three sets of trapezoidal shapes includes a pair of trapezoidal shapes with a common fold line and wherein that common fold line is along the longest leg on each of the pair of trapezoidal shapes;

wherein an inside fold line on a first side connects to an outside fold line on a second side; and a second group of three or more predetermined fold lines extending substantially across the second side;

a second group of three or more predetermined fold lines forming a portion of a plurality of non-trapezoidal shape; and wherein the first side is adjacent the second side.

10. The collapsible container of claim 9 wherein the substantially geometric shape is a substantially rectangular shape.

11. The collapsible container of claim 9 further comprising an opening having a neck on one end for connecting to a pump and a recess on the other end configured to receive at least a portion of the neck portion of a second container thereby allowing the containers to be stacked for shipping.

12. The collapsible container of claim 11 wherein the container is in a collapsed form and stacked with a second container.

13. The collapsible container of claim 9 wherein the fold lines on a plurality of the corners of the container form a zigzag pattern.

14. A collapsible container comprising:

a container having a plurality of predetermined fold lines;

three or more predetermined fold lines on a first side that fold inward and three or more predetermined fold lines on a second side that fold outward;

wherein the three or more predetermined fold lines that fold inward are connected to the three or more predetermined fold lines that fold outward; and wherein the predetermined fold lines form a plurality of geometric shapes wherein at least two of the geometric shapes are triangular shapes and the at least two triangular shapes are adjacent each other; and wherein at least six of the geometric shapes are trapezoidal shapes grouped in at least three sets and each set includes a common fold line and wherein that common fold line is along the longest leg on each of the pair of trapezoidal shapes.

15. The collapsible container of claim 14 wherein at least two of the geometric shapes are trapezoids.

* * * * *